US006928143B2

(12) United States Patent
Menear et al.

(10) Patent No.: US 6,928,143 B2
(45) Date of Patent: Aug. 9, 2005

(54) DEPLOYABLE FAST-RESPONSE APPARATUS TO RECOVER BIO-CONTAMINATED MATERIALS

(76) Inventors: John Edgar Menear, 1200 Capitola Rd., #4, Santa Cruz, CA (US) 95062; Sergey Etchin, 7375 Rollingdel Dr., Apt. 87, Cupertino, CA (US) 95014; Gershon Perelman, 1554 Primrose Way, Cupertino, CA (US) 95014; Jeffrey Allen Moore, 744 Fulton St., #2, Redwood City, CA (US) 94061

( * ) Notice: Subject to any disclaimer, the term of this patent is extended or adjusted under 35 U.S.C. 154(b) by 57 days.

(21) Appl. No.: 10/418,921

(22) Filed: Apr. 21, 2003

(65) Prior Publication Data

US 2004/0208282 A1 Oct. 21, 2004

(51) Int. Cl.[7] ..... G21K 5/00; G21K 5/10

(52) U.S. Cl. ..... 378/69; 378/64; 378/68; 378/198; 250/453.11; 250/454.11; 250/455.11; 250/492.1

(58) Field of Search ..... 378/57, 64, 68, 378/69, 198; 250/453.11, 454.11, 455.11, 492.1

(56) References Cited

U.S. PATENT DOCUMENTS

| | | | | | |
|---|---|---|---|---|---|
| 3,411,002 | A | * | 11/1968 | Armel | 378/69 |
| 6,242,664 | B1 | * | 6/2001 | Crihan | 588/305 |
| 6,437,344 | B1 | * | 8/2002 | Strawson | 250/455.11 |
| 6,463,123 | B1 | * | 10/2002 | Korenev | 378/69 |
| 6,529,577 | B1 | * | 3/2003 | Allen et al. | 378/69 |
| 6,628,750 | B1 | * | 9/2003 | Korenev | 378/64 |
| 2003/0110946 | A1 | * | 6/2003 | Lehman | 95/273 |
| 2003/0122086 | A1 | * | 7/2003 | Ryan et al. | 250/455.11 |
| 2003/0145664 | A1 | * | 8/2003 | Schwartz et al. | 73/863.22 |
| 2003/0174810 | A1 | * | 9/2003 | Korenev et al. | 378/69 |

* cited by examiner

*Primary Examiner*—Allen C. Ho
(74) *Attorney, Agent, or Firm*—John E. Menear

(57) ABSTRACT

A portable apparatus for sanitizing and recovering mail and other materials is disclosed. The apparatus is employed after a known or suspected biological attack or contamination event, such as anthrax. Multiple X-ray sources penetrate mail and other materials, and destroy the biological agents. The apparatus is taken to the location of the biological problem, as opposed to shipping contaminated materials to a fixed facility for recovery. Many safety and practical advantages result from this approach to bio-terrorism or to biological contamination events. The design of this apparatus leads to a self-cleaning feature. Airflow control prevents escape of toxic biological materials into the environment.

23 Claims, 3 Drawing Sheets

DEPLOYABLE FAST-RESPONSE APPARATUS TO RECOVER BIO-CONTAMINATED MATERIALS

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to homeland defense. It is a deployable apparatus, where deployable means portable, mobile, expandable, configurable, self-propelled, or self-contained. This deployable apparatus uses multiple X-ray modules to neutralize known or suspected bio-terrorism attacks or biological contamination events in materials such as mail, clothing, uniforms, personal protective gear, and small arms weapons. The goal is to recover affected materials. Decontamination is performed at the site of the bio-terrorism attack or biological contamination event.

2. Description of Related Art

United States General Accounting Office Report #GAO-02-365 entitled "Diffuse Security Threats", April 2002, is an excellent summary of related work-to-date concerning mail sanitation. This work demonstrates that ionizing radiation (electron beam or X-rays) is an effective way to decontaminate biological weapons, such as Anthrax, in mail. Ionizing radiation dosage ranges between 40–100 kGrays are effective. Flat letters require less exposure than boxes due to less penetration depth. For the convenience of the reader, from this point onward the term "mail" will be understood to include "mail, clothing, uniforms, personal protective gear, and small arms weapons".

Both types of ionizing radiation have advantages and disadvantages. Electron beams have an advantage for high volume mail sanitation because energy is utilized efficiently. However, depth penetration is limited. So, electron beams are not well suited to large packages. X-rays penetrate deeper than electron beams, but energy utilization is only 0.5–3% as effective as electron beams. So, throughput for an X-ray process is lower than for an electron beam process at the same energy consumption.

Electron beam and X-ray generation are nearly 100 years old and well known. A technical description of operating principles is not deemed necessary in this application.

Problems exist for the present technology. Many such problems arise from the way the technology is being applied. Specifically, the direction of prior work has been to develop a method to sanitize all mail at fixed locations. Problems include:

- paper products may be scorched. This is unacceptable if all mail is processed.
- photographic films and electronic data storage devices may be compromised. Again, this is unacceptable if all mail is processed.
- dosage penetration may be insufficient for large packages. Some dangerous biological species might survive.

- a fixed facility invites the possibilities of biohazard escape and cross-contamination into other activities at that fixed facility. As presently conceived, there is no inherent protection against accidental anthrax release from a torn letter.
- a fixed facility using high energy electron beams (up to 10 million electron volts) requires taking extreme radiation precautions, such as protective clothing, restricted zones, and 10-foot-thick concrete barrier walls.
- facility availability becomes an issue when the facility has other uses.
- handling of contaminated mail is excessive, which increases risks. Minimally, contaminated mail must be handled two times unnecessarily. The following three steps are an example. First, a delivery truck has to be loaded with contaminated mail and driven to the fixed decontamination facility. Second, the contaminated mail has to be unloaded at the decontamination facility. Third, the
- contaminated mail has to be loaded onto the decontamination conveyor.
- costs are likely prohibitive. Ten year cost estimates to sanitize all mail at fixed facilities range from $880 million to $4.2 billion.

Without a revised scope of application, ionizing radiation for sanitation of mail is unlikely to be adopted by the United States Postal Service.

BRIEF SUMMARY OF THE INVENTION

The deployable fast response decontamination approach solves the problems with sanitizing all mail at fixed locations. The fast response apparatus takes the solution to the problem, rather than taking the problem to a fixed facility. Also, the fast response apparatus was not designed to sanitize all mail in the United States. It is primarily designed to address known or suspected bio-contamination events.

Inherent in this approach is a greater dependence (relative to the date of this application) on analytical detection methods to define contamination events within the mail system. It is projected that improved analytical and sampling methods will develop in response to the fast response capability that is defined in this application. However, analytical detection methods are outside the scope of this application.

Solutions to the problems within the prior art are listed below. Note that, in some cases, the solution does not always mean that the problem is eliminated. Reducing the magnitude of a cited problem to an acceptable level is also a practical solution. This practical and acceptable level often evolves from treating only mail with defined or suspected biological threats, as opposed to treating all mail. Treating only contaminated mail is a recovery operation, not a routine prevention measure. Specifics follow:

- scorched paper or exposed film is unacceptable when sanitizing all mail. However, when the biological threat is defined, scorched paper or exposed film
- becomes acceptable. Recovery, rather than routine treatment, is understood. Safety and security become more important than aesthetics. It is appropriate to realize that the paper and film are already ruined due to toxic biological exposure. The fact that paper is scorched in the process of recovery is acceptable.
- Large packages are treatable with multiple X-ray sources positioned at multiple angles, which increases sanitation efficiency.

Problems associated with fixed facilities (cross contamination, bio-hazard escape, excessive facility costs, facility availability, and concrete barriers) are obviated.

Handling of contaminated mail is minimal. Normally, only one handling is needed at the site of the contamination.

Economics favor the deployable fast response approach.

DETAILED DESCRIPTION OF THE INVENTION

Figure 1:
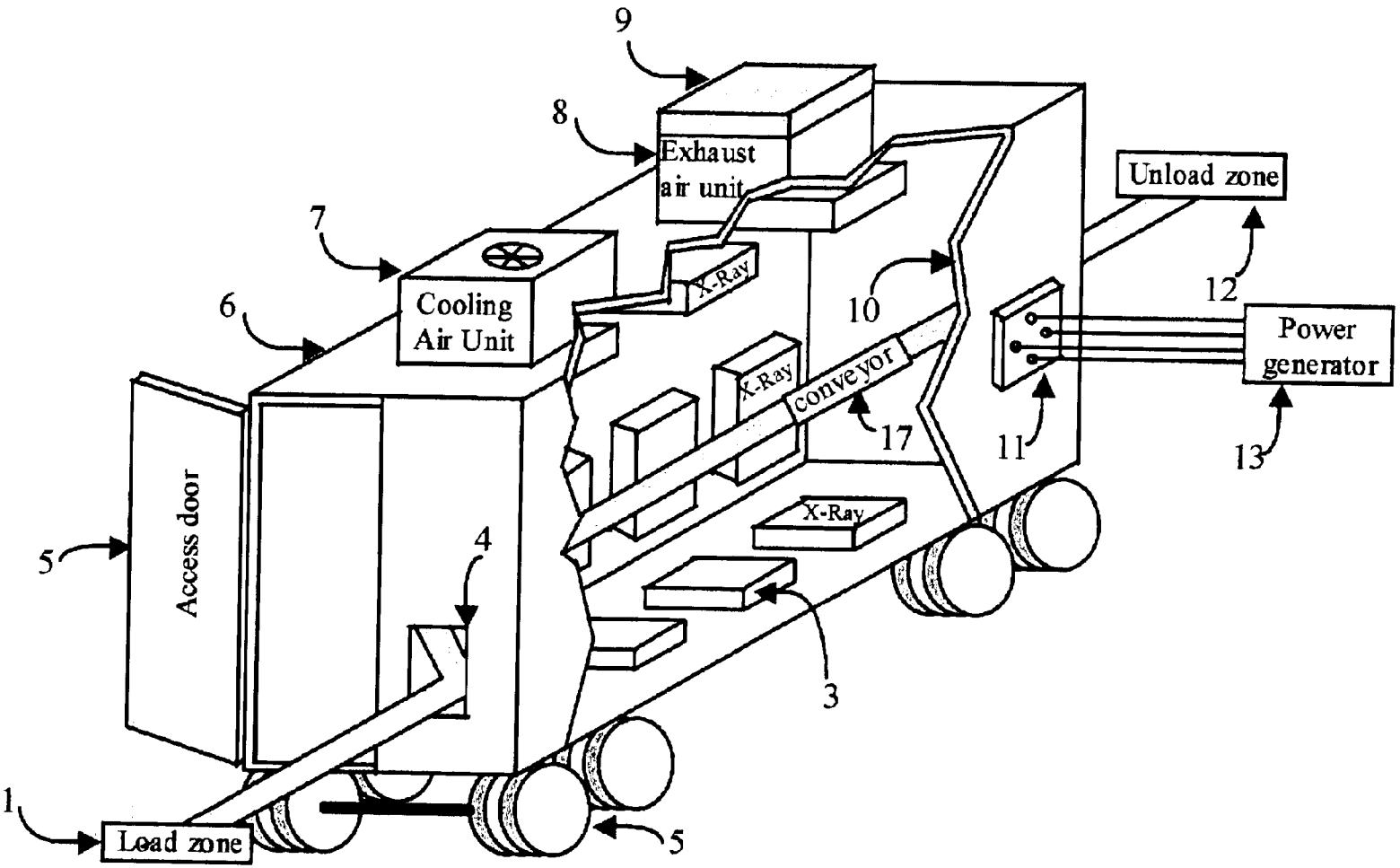
FIG. 1 is a pictorial illustration of the portable fast response apparatus, showing internal components through the right/top cut-away.
Figure 2:
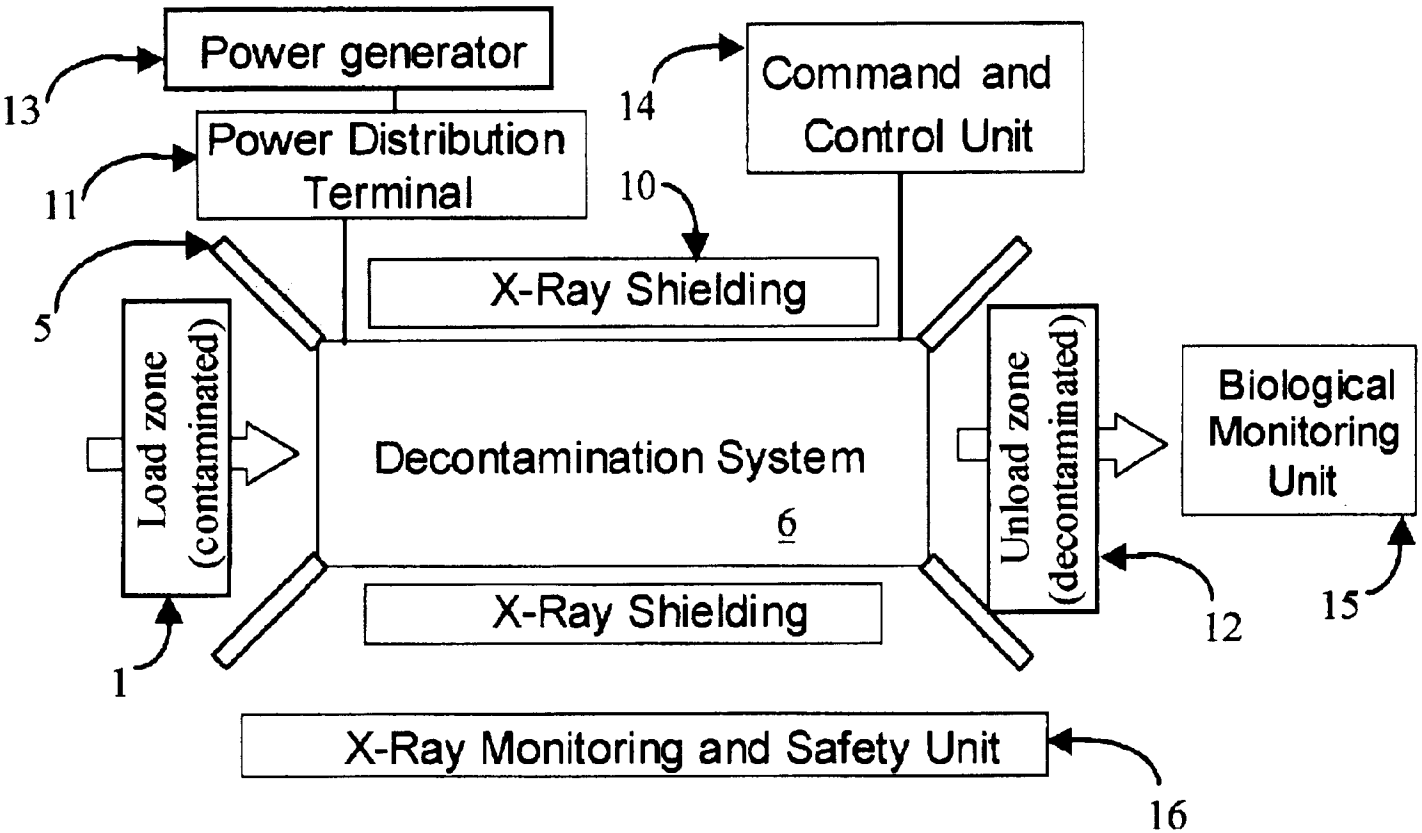
FIG. 2 is a block diagram, which includes the fast response apparatus plus associated external components.

FIG. 1 shows an apparatus for recovering (sanitizing) mail as the mail moves from the load zone to the unload zone. Those sections of conveyor 17 that appear outside the frame of the decontamination system 6 frame are extendable/retractable, and are contained within the frame when the fast response apparatus is not in use.

The load port 4 is the opening through which the contaminated mail, from the load zone 1, enters. The area of this entry port 4 is a critical variable in the airflow design. It is sized based on four variables: the maximum size package to be treated, the volume of cooling air delivered into the decontamination system 6 through the cooling air unit 7, the volume of exhaust air removed from the decontamination system 6 through the exhaust air unit 8, and the area of the unload port (not shown in FIG. 1) leading to the unload zone 12. The reason for accurately defining the entry port 4 area is pressurization control. The access door 5 is always closed during operation. Closure is necessary to develop the required negative pressure. As an example, the following combination would lead to a successful operating system from the viewpoint of pressurization and airflow:

800 cubic feet/minute of air is delivered through the cooling air unit 7, 2000 cubic feet/minute of air is exhausted through the exhaust air unit 8 and through the HEPA filter 9.

the entry port has an unobstructed area of 2 square feet, and the unload port has an unobstructed area of 2 square feet.

Air pressure (relative to the outside air) within the decontamination system 6 of negative 0.005 (or more negative) is developed. At negative 0.005 inches of water, outside air will flow into the decontamination system 6 through all openings or cracks at a linear velocity of 250 to 300 feet/minute. In combination with the HEPA filter 9, this prevents any biological contaminants from escaping to the outside air. No air leaves the decontamination system except through the HEPA filter 9. If a contaminated letter were torn during treatment, the biological material would be contained within the decontamination system 6 and eventually removed by the HEPA filter. This pressurization/air velocity design is consistent with industrial hygiene standards plus mini-environment guidelines used within the semiconductor industry. More negative internal pressures may be used, but they are not required. In addition, if internal pressures are too negative, air velocity and turbulence may become problematic. For example, at negative 0.1 inches of water, inward air velocities approach 1260 feet/minute, and mail could be blown off the conveyor.

The combination of negative pressure and HEPA filtered exhaust also leads to a self-cleaning system (for biologicals). After use, the system is simply operated normally with no mail present. This is particularly important to assure the local populace that the presence of the portable fast-response system in their neighborhood is not a source of worry. It is also a significant advantage over after-the-job cleaning requirements within a fixed facility.

The conveyor 17 incorporates a bend immediately inside the entry door to assist with X-ray shielding. After the bend, the conveyor 17 moves the mail past a series of X-ray generators 3, which are positioned in clusters of two or more. Each cluster of X-ray generators is distributed axially around the conveyor to provide an overlapping pattern. The maximum number of X-ray generators per system is not expected to exceed 200. The actual number is chosen to neutralize the biological threat with a high confidence level. If even greater exposure is needed for large packages or semi-permeable wrappings, the operator may arrange multiple passes through the decontamination system 6. Alternatively, multiple decontamination systems can be linked serially. Each decontamination system is constructed to fit together in a modular and expandable fashion, with adequate sealing to prevent X-ray escape at connection points.

In the best mode contemplated, each X-ray generator 3 operates at high voltage (for example, 0.5–1 million Volts).

The cooling air unit 7 is sufficient to remove the heat from the X-ray generators, heat created by the interaction of X-rays with the mail (150 degree F. temperatures have been documented), plus heat created by sunlight impinging on the outside walls (on a cloudless day, a horizontal surface on June 21$^{st}$ at 45 degrees north latitude at solar noon receives 5.2 BTU's/minute/square foot). Most of the cooling is accomplished by the projected 1–2 air exchanges per minute in a 1000 cubic foot decontamination volume. Some cooling coils for the air may be needed in the cooling air unit 7, but probably not. Cooling coils for air are not planned for the first prototype. In addition to air cooling, separate cooling will be applied to the X-ray generators and shielding.

X-ray shielding 10 is built into the walls. Each wall is constructed with 1–5 inches of lead (or equivalent shielding) in the center. This is sufficient to contain generated X-rays within the decontamination system 6. Escape is less than the safe limits prescribed by FDA/CDRH and OSHA. The shielding 10 as shown in FIG. 1 adds to the overall weight of the decontamination system 6, and a very heavy-duty suspension 5 is required. The weight of any system will be limited to the weight of an M1A2 tank, which is roughly 72 tons. This limit allows the use of an existing suspension system X-ray containment is monitored continuously during operation by the X-ray monitoring and safety unit 16 to assure conformance with EPA and OSHA prescribed limits.

Figure 3:
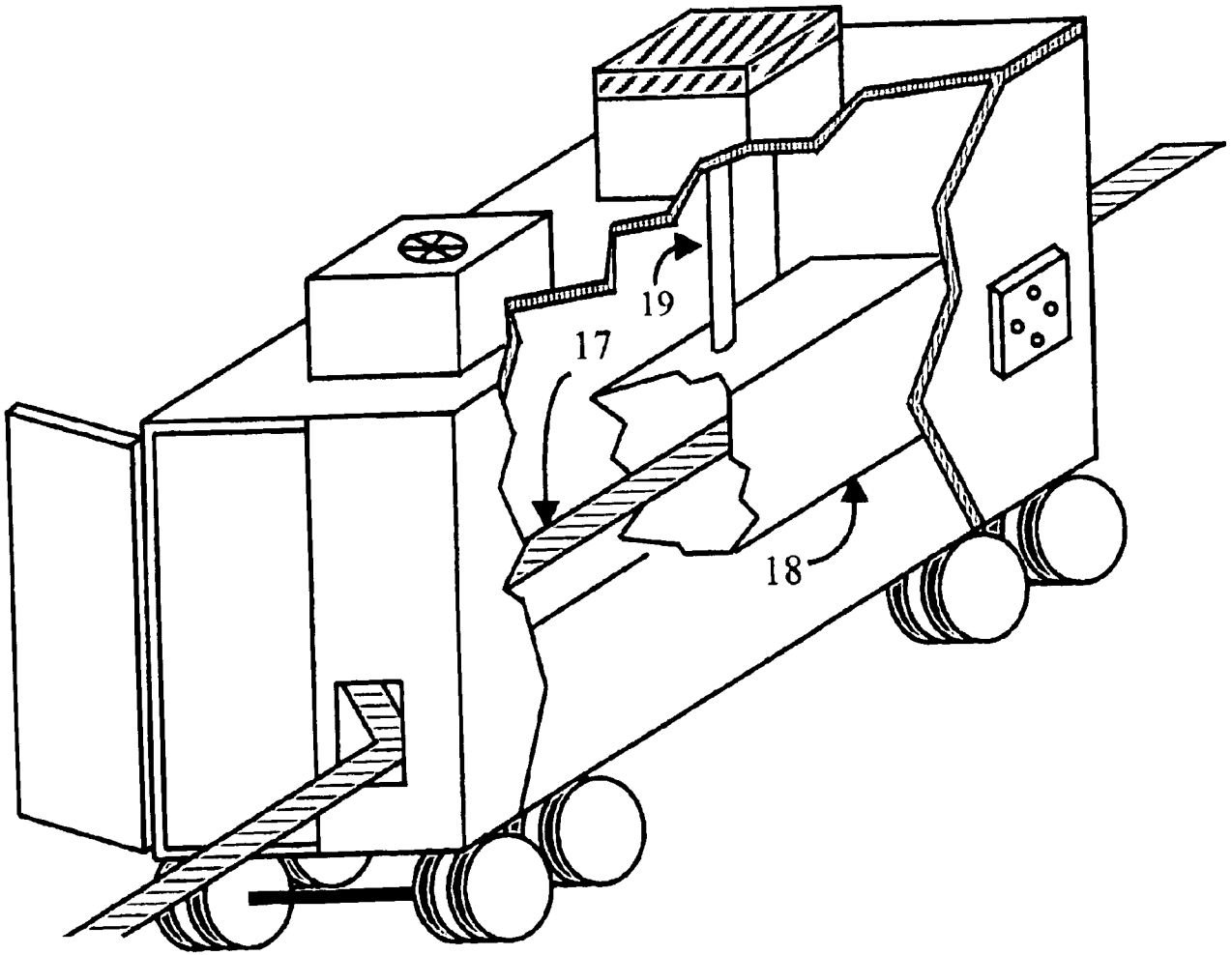
FIG. 3 is a pictorial illustration of a modified X-ray shielding design, showing a shielded tunnel around the conveyor.

Since total system weight is a concern, a useful modification is shown in FIG. 3. The purpose is to reduce the volume (and, hence, weight) of shielding. Rather than use the walls of the decontamination system 6 for shielding, a shielded tunnel 18 around the conveyor 17 is applied. The X-ray generators are mounted close to the tunnel, shine through ports in the tunnel, and are sealed to prevent X-ray escape from the tunnel. For example, substituting a 2.5 ft×2.5 ft×20 ft lead tunnel 18 for the wall shielding 10 reduces the shielding weight by 10 tons. Properly employed, enough of the total exhaust air 8 is pulled from the tunnel to assure a negative pressure of 0.005 inches of water inside the tunnel 18, relative to the air inside of the decontamination system 6. By maintaining the tunnel 18 at a negative pressure to the inside of the decontamination system 6, the self-cleaning feature is maintained. An exhaust duct 19 between the tunnel 18 and the exhaust air unit 8 is used. FIG. 3 shows only the right side of the tunnel, and X-ray stenerators are not shown.

Another approach to weight control during transit is to make the decontamination system easy to assemble and disassemble. Rather than drive the complete portable fast response apparatus to the job site, pieces can be shipped separately and assembled near the job site. Movement of the complete apparatus is then limited to a short trip, if any.

The biological monitoring unit 15 allows confirmation that the biological threat has been neutralized.

The command and control unit 4 is located outside the decontamination system 6.

A power generator 13 provides electrical power to the decontamination system 6 through the power connector 11.

The invention claimed is:

1. A deployable apparatus for sanitizing or recovering mail that has been subjected to a biological attack or biological contamination, comprising:

a decontamination system (6), which contains multiple X-ray generators (3);

a heavy-duty suspension system (5);

an exhaust air unit (8) capable of producing a negative pressure of at least 0.005 inches of water inside the decontamination system;

a HEPA filter (9) at the exit of said exhaust air unit (8), which filters all air returned to the outside of the decontamination system;

an entry port (4) and an unload port;

shielding (10) to contain X-rays within the decontamination system;

an X-ray monitoring and safety unit (16) outside the decontamination system;

a command and control unit (14) outside the decontamination system;

a biological monitoring unit (15) to confirm sanitation; and a power connector (11).

2. The apparatus in claim 1 in which the X-ray generators (3) operate at 15–20 kVolts of accelerating voltage.

3. The apparatus in claim 1 in which the X-ray generators (3) operate at 20–200 kVolts of accelerating voltage.

4. The apparatus in claim 1 in which the X-ray generators (3) operate at 200–1000 kVolts of accelerating voltage.

5. The apparatus in claim 1 in which the heavy-duty suspension system (5) is capable of supporting up to 72 tons.

6. The apparatus in claim 1 in which the inside of the decontamination system (6) operates at a negative pressure of 0.005–0.04 inches of water, relative to the air outside the decontamination system (6).

7. The apparatus in claim 6 which is further capable of removing 10–500 BTUs per minute of heat from within the decontamination system (6).

8. The apparatus in claim 6 which is further capable of removing 500–2000 BTUs per minute of heat from within the decontamination system (6).

9. The apparatus in claim 1 in which the inside of the decontamination system (6) operates at a negative pressure of 0.04–10 inches of water, relative to the air outside the decontamination system (6).

10. The apparatus in claim 9 which is further capable of removing 10–500 BTUs per minute of heat from within the decontamination system (6).

11. The apparatus in claim 9 which is further capable of removing 500–2000 BTUs per minute of heat from within the decontamination system (6).

12. The apparatus in claim 1 in which shielding is 1 to 5-inch-thick lead plate contained within the walls of the decontamination system.

13. The apparatus in claim 1 in which shielding is a 1 to 5-inch-thick lead tunnel (17) surrounding the full length of the conveyor.

14. The apparatus in claim 13 openings are provided in the tunnel for X-ray entry and ducted airflow.

15. The apparatus in claim 1 in which power is provided from an external generating source.

16. The apparatus in claim 1 in which power generators are integrally included into the deployable apparatus.

17. The apparatus in claim 1 wherein the decontamination system is modularly constructed construction, allowing shipment in segments.

18. The apparatus in claim 1 where an extendable conveyor (17) may be extended for loading and unloading mail, and retracted during movement of the apparatus.

19. The apparatus in claim 1 where a separate cooling air unit (7) is added to supplement heat removal.

20. The apparatus in claim 1 for which the decontamination system (6) can attach end-to-end to a plurality of identical decontamination systems (6) without X-ray loss at the junctions.

21. The apparatus in claim 1 where a conveyor (17) is added for loading, unloading, and transporting mail past the X-ray generators.

22. A deployable apparatus for sanitizing or recovering mail that has been subjected to a biological attack or biological contamination, comprising:

a decontamination system (6), which contains multiple X-ray generators (3);

a heavy-duty suspension system (5);

an exhaust air unit (8) capable of producing a negative pressure of at least 0.005 inches of water inside the decontamination system;

a HEPA filter (9) at the exit of said exhaust air unit (8), which filters all air returned to the outside of the decontamination system;

an entry port (4) and an unload port;

shielding (10) to contain X-rays within the decontamination system;

a command and control unit (14) outside the decontamination system; and a power connector (11).

23. A method of sanitizing or recovering mail that has been subjected to a biological attack or biological contamination, comprising:

placing mail inside a decontamination system (6);

exposing mail to a plurality of X-ray generators (3);

maintaining a negative pressure of at least 0.005 inches of water inside the decontamination system (6);

filtering the exhaust air from the inside of the decontamination system (6) through a HEPA filter (9);

providing an entry port and an exit port;

providing X-ray shielding;

providing a heavy-duty suspension system;

providing a command and control unit (14) outside the decontamination system; and providing a means for power introduction to the decontamination system (6).

* * * * *